US011238791B2

(12) United States Patent
Chen

(10) Patent No.: US 11,238,791 B2
(45) Date of Patent: Feb. 1, 2022

(54) DISPLAY DATA CORRECTION METHOD, DISPLAY DRIVING METHOD AND DISPLAY DEVICE

(71) Applicant: KUNSHAN GO-VISIONOX OPTO-ELECTRONICS CO., LTD., Kunshan (CN)

(72) Inventor: Xinquan Chen, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 17/142,249

(22) Filed: Jan. 6, 2021

(65) Prior Publication Data

US 2021/0134218 A1 May 6, 2021

Related U.S. Application Data

(63) Continuation of application No. PCT/CN2019/098377, filed on Jul. 30, 2019.

(30) Foreign Application Priority Data

Jan. 18, 2019 (CN) ..... 201910048989.6

(51) Int. Cl.
*G09G 3/3225* (2016.01)
*G09G 3/20* (2006.01)

(52) U.S. Cl.
CPC ..... *G09G 3/3225* (2013.01); *G09G 3/2007* (2013.01); *G09G 2320/0209* (2013.01); *G09G 2340/14* (2013.01)

(58) Field of Classification Search
CPC ..... G09G 2320/0209
See application file for complete search history.

(56) References Cited

U.S. PATENT DOCUMENTS

2007/0080905 A1* 4/2007 Takahara ..... G09G 3/3233 345/76
2008/0266210 A1 10/2008 Nonaka
2009/0309813 A1 12/2009 Fujita
2014/0253419 A1 9/2014 Tanada
2018/0166003 A1 6/2018 Wang et al.
(Continued)

FOREIGN PATENT DOCUMENTS

CN 101295081 A 10/2008
CN 107644410 A 1/2018
(Continued)

OTHER PUBLICATIONS

First Office Action of Chinese Application No. 2019100489896.
(Continued)

*Primary Examiner* — Gustavo Polo
(74) *Attorney, Agent, or Firm* — Kilpatrick Townsend & Stockton

(57) ABSTRACT

The present application provides a display data correction method, a display driving method and a display device. The display data correction method includes: receiving display data corresponding to pixel units of an irregularly-shaped display screen; determining whether the pixel units are in an area to be corrected; and if the pixel units are in the area to be corrected, correcting the display data corresponding to the pixel units to generate corrected display data.

6 Claims, 5 Drawing Sheets

(56) References Cited

U.S. PATENT DOCUMENTS

| | | | |
|---|---|---|---|
| 2020/0005704 | A1 | 1/2020 | Tong et al. |
| 2020/0082798 | A1 | 3/2020 | Zhang |
| 2020/0202817 | A1 | 6/2020 | Li et al. |

FOREIGN PATENT DOCUMENTS

| | | | |
|---|---|---|---|
| CN | 107742497 | A | 2/2018 |
| CN | 108198534 | A | 6/2018 |
| CN | 108492773 | A | 9/2018 |
| CN | 108615499 | A | 10/2018 |
| CN | 108646492 | A | 10/2018 |
| CN | 108806639 | A | 11/2018 |
| CN | 108831368 | A | 11/2018 |
| CN | 108957888 | A | 12/2018 |
| CN | 109712567 | A | 5/2019 |
| CN | 110211537 | A | 9/2019 |
| WO | 2020147296 | A1 | 7/2020 |

OTHER PUBLICATIONS

Second Office Action of Chinese Application No. 2019100489896.
Search Report of International Application No. PCT/CN2019/098377.
Written Opinion of International Application No. PCT/CN2019/098377.

* cited by examiner

DISPLAY DATA CORRECTION METHOD, DISPLAY DRIVING METHOD AND DISPLAY DEVICE

CROSS-REFERENCE TO RELATED APPLICATIONS

The present application is a continuation to International Application No. PCT/CN2019/098377, filed on Jul. 30, 2019, which claims priority to Chinese Patent Application No. 201910048989.6, filed on Jan. 18, 2019. Both applications are incorporated by reference herein in their entireties for all purposes.

FIELD OF THE INVENTION

The present application relates to the field of display technology.

BACKGROUND OF THE INVENTION

With the development of electronic technology, electronic display screens have become more and more diversified, and irregularly-shaped display screens have appeared accordingly.

SUMMARY OF THE INVENTION

Embodiments of the present application provide a display data correction method, a display driving method and a display device, to solve the problem of poor display of images on an irregularly-shaped display screen.

To achieve the above-mentioned objective, the present invention adopts the following technical solutions:

According to a first aspect, an embodiment of the present application provides a display data correction method, including: receiving display data corresponding to pixel units of an irregularly-shaped display screen; determining whether the pixel units are in an area to be corrected; and if the pixel units are in the area to be corrected, correcting the display data corresponding to the pixel units to generate corrected display data. In the display data correction method provided by the embodiment of the present application, whether the pixel units are in the area to be corrected is determined, and the display data corresponding to the pixel units in the area to be corrected is corrected, so that cross talk can be reduced or even eliminated, thereby achieving normal display of images on the irregularly-shaped display screen.

According to a second aspect, an embodiment of the present application provides a display driving method, including: receiving display data corresponding to pixel units of an irregularly-shaped display screen; outputting the display data to the respective pixel units of the irregularly-shaped display screen; determining whether the pixel units are in an area to be corrected; if the pixel units are in the area to be corrected, correcting the display data corresponding to the pixel units to generate corrected display data; and driving the pixel units in the area to be corrected to display the corrected display data. In the display driving method provided by the embodiment of the present application, first, a received display data full-image is output to the pixel units of the irregularly-shaped display screen, then whether the pixel units are in the area to be corrected is determined, and the display data corresponding to the pixel units in the area to be corrected is corrected, so that cross talk is reduced or even eliminated, and normal display of images on the irregularly-shaped display screen is achieved.

According to a third aspect, an embodiment of the present application provides a display device, including a memory and a processor, wherein the memory and the processor are communicatively connected to each other, and the memory stores computer instructions, which are executable by the processor to perform the display data correction method in the first aspect of the present application or any implementation of the first aspect or perform the display driving method in the second aspect of the present application or any implementation of the second aspect. In the display device provided by the embodiment of the present application, the memory and the processor are used to perform the above-mentioned display data correction method or display driving method, to correct the display data corresponding to the pixel units in the area to be corrected, so that cross talk is reduced or even eliminated, and normal display of images on the irregularly-shaped display screen is achieved.

DETAILED DESCRIPTION OF THE EMBODIMENTS

An image actually transmitted by a driver chip in an irregularly-shaped display screen to an irregularly-shaped slot is a black image with a gray scale of 0, and thus poor display of the image may occur if a normally displayed image is a bright image with a gray scale of 255 or a high gray scale.

Technical solutions of the present application will be described clearly and completely below with reference to the accompanying drawings.

In addition, technical features involved in different embodiments of the present application described below may be combined with each other so long as they do not conflict with each other.

Figure 1:
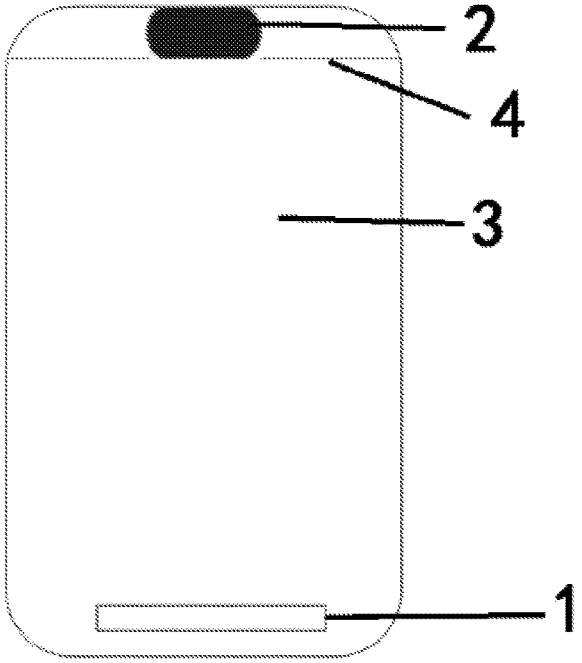
FIG. 1 is a schematic diagram of a specific example of an irregularly-shaped display screen.

As shown in FIG. 1, an image actually transmitted by a driver chip 1 in an irregularly-shaped display screen to an irregularly-shaped slot 2 is a black image with a gray scale of 0. If an image displayed in a normal display area 3 is an image with a gray scale of 255 or a high gray scale, due to mutual coupling between data traces and between the data traces and a driving power source (ELVDD), cross talk 4 is prone to occur at the boundary between the irregularly-shaped slot 2 and the normal display area 3, which may cause data transmission losses and transmission errors, thereby resulting in poor display of images. The irregularly-shaped display screen may be an irregularly-shaped AMOLED (Active-matrix organic light-emitting diode) display screen. Alternatively, further, the irregularly-shaped display screen may be an irregularly-shaped AMOLED full display screen.

Figure 2:
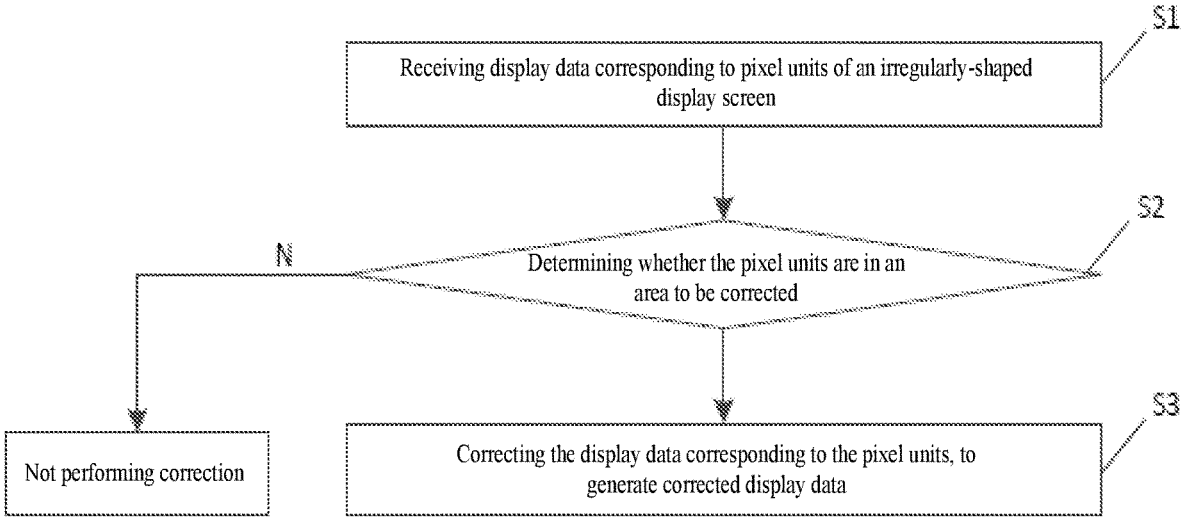
FIG. 2 is a flow diagram of a specific example of a display data correction method in an embodiment of the present application.

Based on this, the present application provides a display data correction method, as shown in FIG. 2, the display data correction method including:

Step S1: receiving display data corresponding to pixel units of an irregularly-shaped display screen.

Step S2: determining whether the pixel units are in an area to be corrected.

Specifically, the pixel units of the irregularly-shaped display screen may be configured with addresses so that the pixel units are driven independently. For a customized irregularly-shaped display screen, an address set of pixel units in an area to be corrected of the irregularly-shaped display screen is determined. Therefore, by determining whether configured addresses of pixel units corresponding to display data belong to the address set, it can be determined whether the pixel units are in the area to be corrected. Alternatively, other methods may also be used to determine whether the pixel units are in the area to be corrected.

Figure 3:
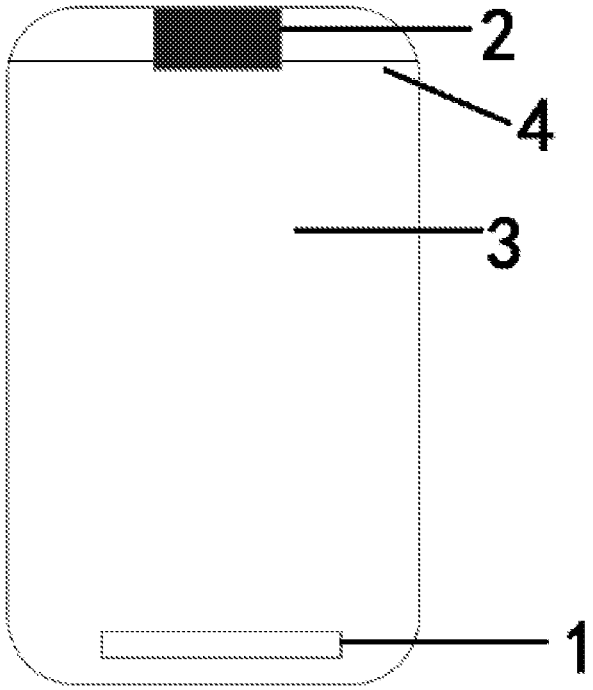
FIG. 3 is a schematic diagram of another specific example of an irregularly-shaped display screen.
Figure 4:
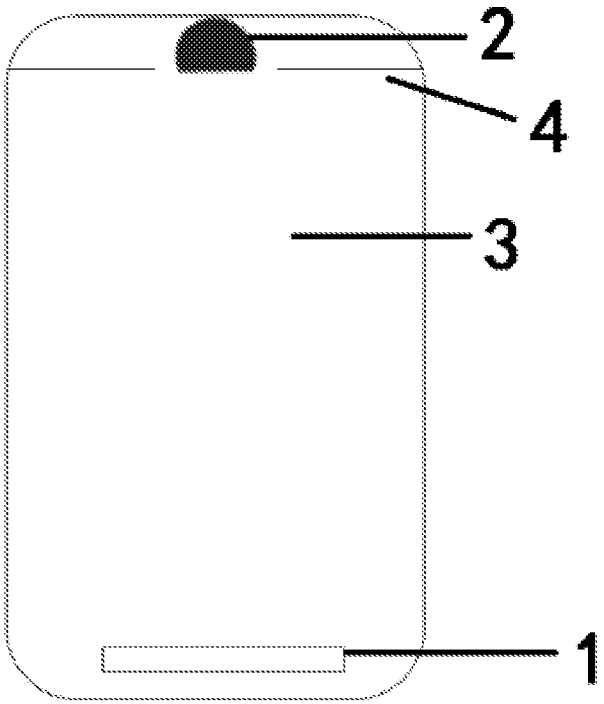
FIG. 4 is a schematic diagram of yet another specific example of an irregularly-shaped display screen.

Referring to FIG. 1, the area to be corrected of the irregularly-shaped display is the irregularly-shaped slot 2. For a display panel, the area is a hollowed-out area; and for the driver chip 1, the area is an area to which display data is transmitted normally. The area may be elliptical as shown in FIG. 1, rectangular as shown in FIG. 3 or semi-circular as shown in FIG. 4, or may be in the shape of a combination of an ellipse, a rectangle and a semi-circle. The present application is not limited thereto.

Figure 5:
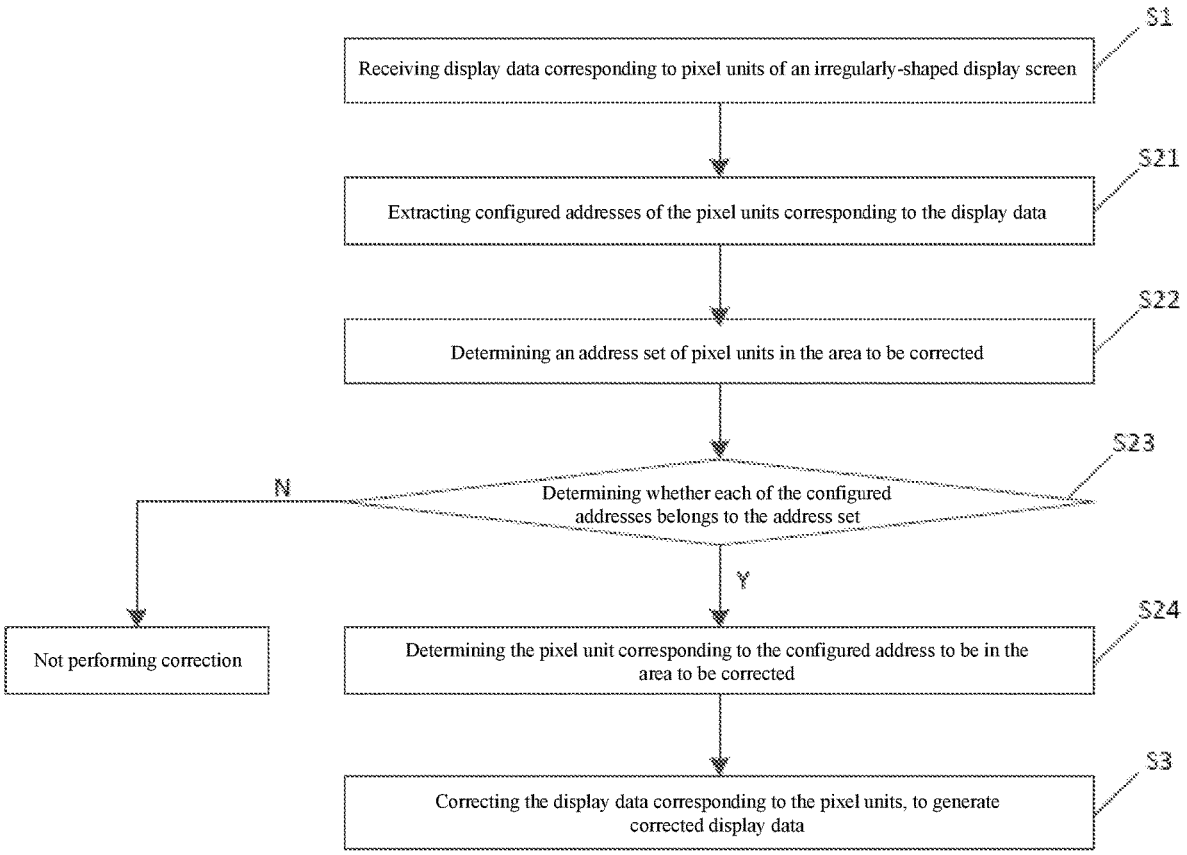
FIG. 5 is a flow diagram of another specific example of a display data correction method in an embodiment of the present application.

As shown in FIG. 5, the above-mentioned step S2 may specifically include the following steps S21 to S24:

Step S21: extracting configured addresses of the pixel units corresponding to the display data;

Step S22: confirming an address set of pixel units in the area to be corrected;

Step S23: determining whether each of the configured addresses belongs to the address set; and Step S24: if the configured address belongs to the address set, determining the pixel unit corresponding to the configured address to be in the area to be corrected.

Specifically, for a customized irregularly-shaped display screen, configured addresses corresponding to pixel units of the irregularly-shaped display screen are fixed, and addresses of pixel units of an area to be corrected of the irregularly-shaped display screen are also fixed. Therefore, the addresses of the pixel units in the area to be corrected may form an address set. After the configured addresses of the pixel units corresponding to the display data are extracted, the configured addresses may be compared with the address set corresponding to the area to be corrected to determine whether each configured address belongs to the address set. When a certain configured address is determined to belong to the address set, it is determined that the pixel unit corresponding to the configured address is in the area to be corrected.

Step S3: if the pixel units are in the area to be corrected with respect to the irregularly-shaped display screen, correcting the display data corresponding to the pixel units to generate corrected display data.

In the display data correction method provided by the embodiment of the present application, by determining whether the configured addresses of the pixel unites corresponding to the received display data belong to the address set, it is determined whether the pixel units are in the area to be corrected, so as to correct the display data corresponding to the pixel units in the area to be corrected, by setting the display data corresponding to the pixel units in the area to be corrected to a predefined gray scale value or a high impedance state or by setting gradually changed gray scale values in a predefined direction of the area to be corrected, so that cross talk is reduced or even eliminated, and normal display of images on the irregularly-shaped display screen is achieved.

Optionally, in some embodiments of the present application, correcting the display data corresponding to the pixel units may be setting the display data corresponding to the pixel units in the area to be corrected to a predefined gray scale value, which is an intermediate gray scale value between 0 and 255. For example, it may be set to a gray scale of 127 or 128, or a value within an intermediate gray scale interval, such as a gray scale value within the gray scale range of 120 to 135.

Optionally, in some other embodiments of the present application, correcting the display data corresponding to the pixel units may be setting the display data corresponding to the pixel units in the area to be corrected to a high impedance state.

Optionally, in some other embodiments of the present application, correcting the display data corresponding to the pixel units may also be setting the display data corresponding to the pixel units in the area to be corrected to a plurality of gray scale values, wherein the display data of each gray scale value respectively corresponds to at least one pixel unit in the area to be corrected. For example, the area to be corrected is divided into a plurality of sub-areas, and each sub-area has at least one pixel unit therein, wherein each sub-area corresponds to one gray scale value. That is, it may be so understood that pixel units in the same sub-area correspond to one gray scale value. In the case where there is one pixel unit in the same sub-area, a gray scale value corresponds to the pixel unit in a one-to-one manner; and in the case where there are two or more pixel units in the same sub-area, one gray scale value corresponds to two or more pixel units in the same sub-area.

Optionally, gray scale values of the display data corresponding to the pixel units in the area to be corrected are set to gradually change in a predefined direction of the area to be corrected. For example, referring to FIG. 1, the predefined direction is from bottom to top, and specifically, in the irregularly-shaped slot 2, a direction from the vicinity of the normal display area 3 to the remoteness from the normal display area 3 is defined as being from bottom to top. Hence, the gray scale values corresponding to the display data corresponding to the pixel units in the area to be corrected change from large to small in the bottom-to-top direction.

Specifically, a maximum value of the plurality of gray scale values is 127 or 128, and a minimum value of the plurality of gray scale values is 0. For example, the gray scale values in the area to be corrected may be set to decrease progressively from 127 to 0 in the bottom-to-top direction. This implementation is only a schematic example for illustration, and other implementations may also be adopted in other embodiments of the present application, and the present application is not limited thereto.

Figure 6:
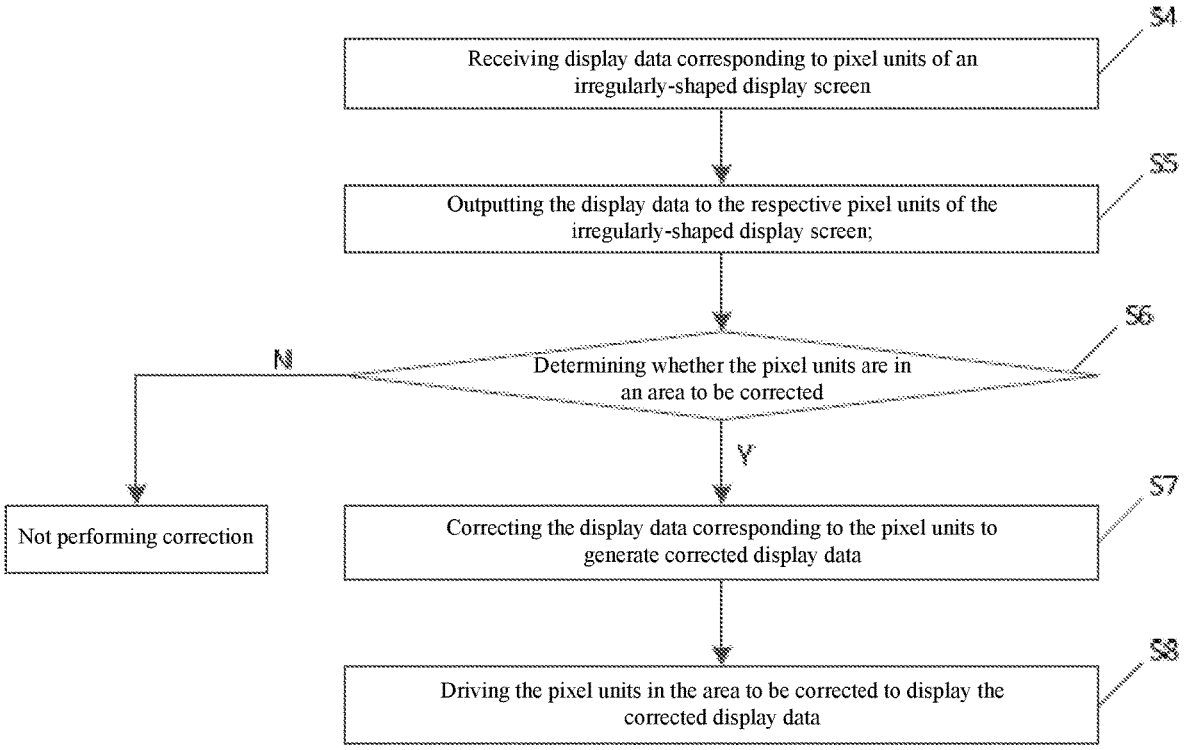
FIG. 6 is a flow diagram of a specific example of a display driving method in an embodiment of the present application.

An embodiment of the present application further provides a display driving method. As shown in FIG. 6, the display driving method includes the following steps:

Step S4: receiving display data corresponding to pixel units of an irregularly-shaped display screen. For details, please refer to the relevant description of step S1 in the above embodiment of the display data correction method.

Step S5: outputting the display data to the respective pixel units of the irregularly-shaped display screen; Specifically, after the display data is received, the display data is not processed, and the display data (that is, a full-resolution unprocessed full-image) is directly output to the respective pixel units of the irregularly-shaped display screen.

Step S6: determining whether the pixel units are in an area to be corrected. For details, please refer to the relevant description of step S2 in the above embodiment of the display data correction method.

Step S7: if the pixel units are in the area to be corrected, correcting the display data corresponding to the pixel units to generate corrected display data. For details, please refer to the relevant description of step S3 in the above embodiment of the display data correction method.

Step S8: driving the pixel units in the area to be corrected to display the corrected display data.

In the display driving method of the irregularly-shaped display screen provided by the embodiment of the present application, first, the received display data is output to the pixel units of the irregularly-shaped display screen, then whether the pixel units are in the area to be corrected is determined, and the display data corresponding to the pixel units in the area to be corrected is corrected by setting the display data corresponding to the pixel units in the area to be corrected to a predefined gray scale value or a high impedance state or by setting gradually changed gray scale values in a predefined direction of the area to be corrected, so that cross talk is reduced or even eliminated, and normal display of images on the irregularly-shaped display screen is achieved.

Figure 7:
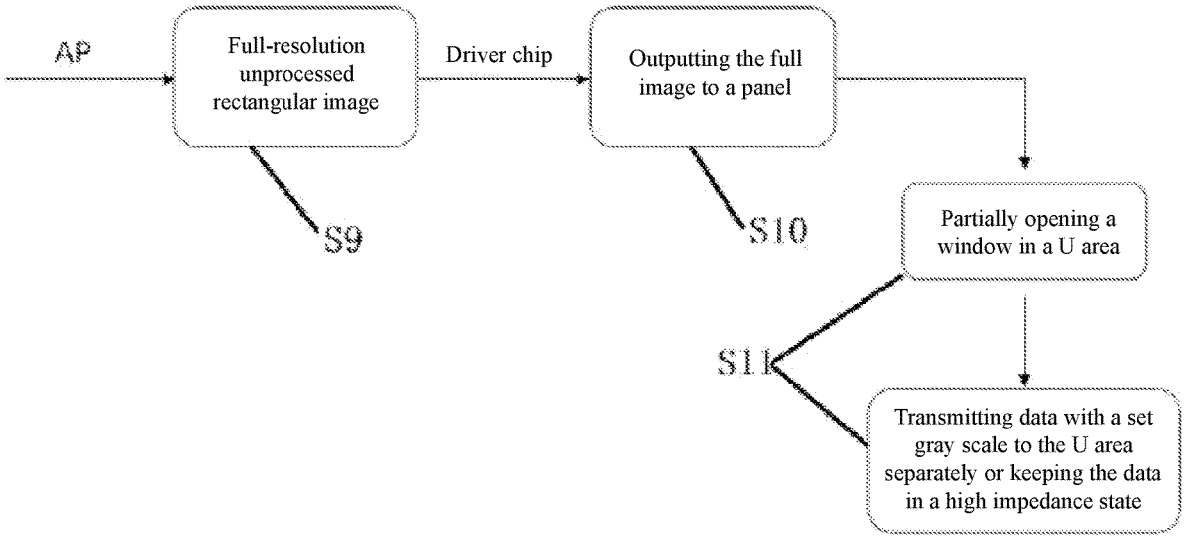
FIG. 7 is a schematic diagram of a specific example of a display driving method in an embodiment of this application.

In specific applications, as shown in FIG. 7, the display driving method of the irregularly-shaped display screen may include the following steps:

Step S9: transmitting, by an application processor (AP), a full-resolution unprocessed rectangular image to a driver chip.

Step S10: outputting, by the driver chip, the received full image to a display panel.

Step S11: partially opening a window in a U area (irregularly-shaped slot area), and transmitting corrected display data to the U area separately. For the correction method, please refer to the relevant description in the above embodiment of the display data correction method.

Through the above steps S9 to S11, the display driving method of the irregularly-shaped display screen provided by the embodiment of the present application achieves correction of the display data in the U area, reduces or even eliminates cross talk, and achieves normal display of images on the irregularly-shaped display screen.

Figure 8:
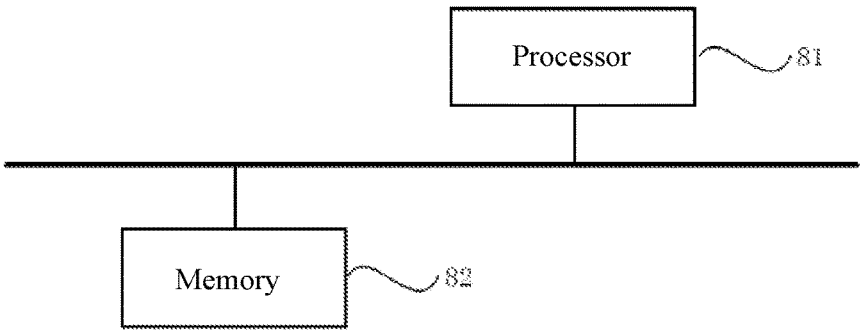
FIG. 8 is a schematic diagram of a specific example of a display device in an embodiment of the present application.

An embodiment of the present application further provides a display device. As shown in FIG. 8, the display device includes a processor 81 and a memory 82, wherein the processor 81 and the memory 82 are communicatively connected to each other, and the memory 82 stores computer instructions, which are executable by the processor 81 to perform the display data correction method or the display driving method of the irregularly-shaped display screen in the above method embodiment of the present application.

In the display device provided in the embodiment of the present application, the processor 81 and the memory 82 may be connected through a bus or in other manner. The connection through a bus is used as an example in FIG. 8.

The processor 81 may be a central processing unit (CPU). The processor 81 may also be other general-purpose processor, a digital signal processor (DSP), an application specific integrated circuit (ASIC), a field-programmable gate array (FPGA), or other programmable logic device, a discrete gate or transistor logic device, a discrete hardware component or other chip, or a combination of the above-mentioned various types of chips.

The memory 82, as a non-transitory computer-readable storage medium, may be used to store non-transitory software programs, non-transitory computer executable programs and modules, such as program instructions/modules corresponding to the display data correction method or the display driving method of the irregularly-shaped display screen in the embodiments of the present application. The processor 81 runs the non-transitory software programs, instructions and modules stored in the memory 82, to execute various functional applications and data processing of the processor, that is, to implement the display data correction method or the display driving method of the irregularly-shaped display screen in the embodiments of the present application.

The memory 82 may include a program storage area and a data storage area, where the program storage area may store an operating system and an application program required by at least one function; and the data storage area may store data created by the processor 81, and the like. In addition, the memory 82 may include a high-speed random access memory, and may also include a non-transitory memory, such as at least one magnetic disk storage device, flash memory device, or other non-transitory solid-state storage device. In some embodiments, the memory 82 may optionally include memories remotely provided from the processor 81, and these remote memories may be connected to the processor 81 through a network. Examples of the network described above include, but are not limited to, the Internet, an intranet, a local area network, a mobile communication network and combinations thereof.

Specific details of the above-mentioned display device may be understood by correspondingly referring to the corresponding related description and effects in the embodiments shown in FIGS. 1 to 7, which will not be repeated here.

Those skilled in the art can understand that all or part of the processes in the methods in the above embodiments may be implemented by relevant hardware instructed by a computer program, and the program may be stored in a computer-readable storage medium. The program, when executed, may include the processes of the above method embodiments. The storage medium may be a magnetic disk, an optical disk, a read-only memory (ROM), a random access memory (RAM), a flash memory, a hard disk drive (HDD), a solid-state drive (SSD), or the like; and the storage medium may also include a combination of the aforementioned types of storage.

What is claimed is:

1. A display data correction method, comprising:

receiving display data corresponding to a plurality of pixel units of an irregularly-shaped display screen;

determining whether the pixel units are in an area to be corrected; and if the pixel units are in the area to be corrected, correcting the display data corresponding to the pixel units to generate corrected display data, wherein correcting the display data further comprises setting the display data corresponding to the pixel units in the area to be corrected to at least one gray scale value, wherein correcting the display data corresponding to the pixel units comprises:

setting the display data corresponding to the pixel units in the area to be corrected to a plurality of gray scale values of the at least one gray scale value, wherein the display data of each gray scale value respectively corresponds to at least one pixel unit in the area to be corrected; and wherein the gray scale values of the display data corresponding to the pixel units in the area to be corrected are set to gradually change in a predefined direction of the area to be corrected.

2. The correction method according to claim 1, wherein a maximum value of the plurality of gray scale values is 127 or 128, and a minimum value of the plurality of gray scale values is 0.

3. The correction method according to claim 1, wherein the step of determining whether the pixel units are in the area to be corrected comprises:

extracting configured addresses of the pixel units corresponding to the display data;

confirming an address set of pixel units in the area to be corrected;

determining whether each of the configured addresses belongs to the address set; and if the configured address belongs to the address set, determining the pixel unit corresponding to the configured address to be in the area to be corrected.

4. A display driving method, comprising:

receiving display data corresponding to pixel units of an irregularly-shaped display screen;

outputting the display data to the respective pixel units of the irregularly-shaped display screen;

determining whether the pixel units are in an area to be corrected;

if the pixel units are in the area to be corrected, correcting the display data corresponding to the pixel units to generate corrected display data, wherein correcting the display data further comprises setting the display data corresponding to the pixel units in the area to be corrected to at least one gray scale value, wherein correcting the display data corresponding to the pixel units comprises:

setting the display data corresponding to the pixel units in the area to be corrected to a plurality of gray scale values of the at least one gray scale value, wherein the display data of each gray scale value respectively corresponds to at least one pixel unit in the area to be corrected; and wherein the gray scale values of the display data corresponding to the pixel units in the area to be corrected are set to gradually change in a predefined direction of the area to be corrected; and driving the pixel units in the area to be corrected to display the corrected display data.

5. A display device, comprising:

a memory and a processor, wherein the memory and the processor are communicatively connected to each other, and the memory stores computer instructions, which are executable by the processor to perform the display driving method of claim 4.

6. The display device of claim 5, wherein a maximum value of the plurality of gray scale values is 127 or 128, and a minimum value of the plurality of gray scale values is 0.

* * * * *